US008343699B2

(12) United States Patent
Nagasaka et al.

(10) Patent No.: US 8,343,699 B2
(45) Date of Patent: Jan. 1, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Hideaki Nagasaka, Suntou-gun (JP); Kunihiko Sekido, Numazu (JP); Michiyo Sekiya, Mishima (JP); Shinji Takagi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 333 days.

(21) Appl. No.: 12/625,810

(22) Filed: Nov. 25, 2009

(65) Prior Publication Data

US 2011/0104597 A1 May 5, 2011

(30) Foreign Application Priority Data

Nov. 2, 2009 (JP) ..... 2009-252077

(51) Int. Cl.
*G03G 21/18* (2006.01)

(52) U.S. Cl. ..... 430/60; 430/56; 430/66

(58) Field of Classification Search ..... 430/56–79
See application file for complete search history.

(56) References Cited

U.S. PATENT DOCUMENTS

| | | | | |
|---|---|---|---|---|
| 4,256,822 A | | 3/1981 | Tarumi et al. | 430/62 |
| 4,418,117 A | * | 11/1983 | Shaw | 428/327 |
| 4,442,193 A | | 4/1984 | Chen et al. | 430/83 |
| 4,933,246 A | * | 6/1990 | Teuscher | 430/64 |
| 4,992,349 A | | 2/1991 | Chen et al. | 430/58 |
| 5,128,226 A | | 7/1992 | Hung | |
| 5,468,583 A | | 11/1995 | Gruenbaum et al. | 430/58 |
| 6,750,288 B2 | | 6/2004 | Pradel | 525/100 |
| 6,831,131 B2 | | 12/2004 | Bouilloux et al. | 525/191 |
| 2003/0187128 A1 | | 10/2003 | Shiba et al. | 524/556 |
| 2004/0259009 A1 | | 12/2004 | Itami et al. | 430/60 |
| 2005/0282076 A1 | * | 12/2005 | Tanaka et al. | 430/60 |
| 2007/0292780 A1 | * | 12/2007 | Nagai et al. | 430/58.2 |

FOREIGN PATENT DOCUMENTS

| | | |
|---|---|---|
| EP | 0 049 623 | 10/1981 |
| JP | 48-026141 | 4/1973 |
| JP | 51-126149 | 11/1976 |
| JP | 52-010138 | 1/1977 |
| JP | 52-020836 | 2/1977 |
| JP | 57-090639 | 6/1982 |
| JP | 58-095351 | 6/1983 |
| JP | 2003-105145 | 4/2003 |
| JP | 2003-119328 | 4/2003 |
| JP | 2003-147028 | 5/2003 |
| JP | 2003-268164 | 9/2003 |
| JP | 2005-010591 | 1/2005 |

OTHER PUBLICATIONS

Search Report dated Jan. 7, 2011 in European Application No. 09177197.2.

Chinese Office Action dated Aug. 14, 2012 in Chinese Application No. 200910207482.7.

* cited by examiner

*Primary Examiner* — Mark F Huff
*Assistant Examiner* — Rashid Alam
(74) *Attorney, Agent, or Firm* — Fitzpatrick, Cella, Harper & Scinto

(57) ABSTRACT

Provided is an electrophotographic photosensitive member having a conductive support, an intermediate layer provided on the conductive support, and a photosensitive layer provided on the intermediate layer in which the intermediate layer contains a polyolefin resin containing a specific component at a specific mass ratio, and a process cartridge and an electrophotographic apparatus each having the electrophotographic photosensitive member.

4 Claims, 1 Drawing Sheet

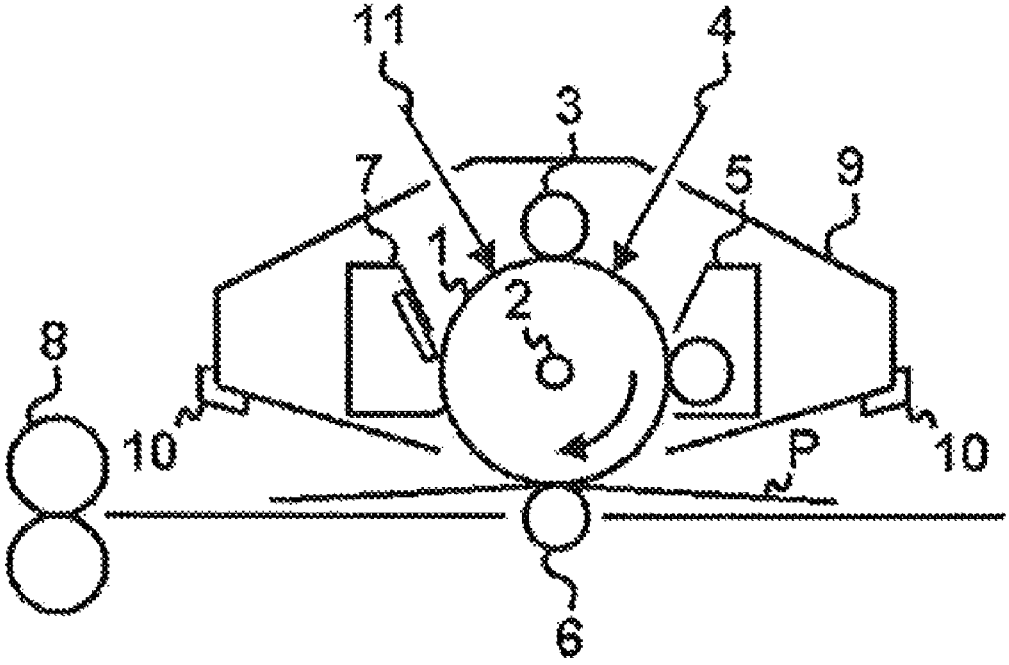
11
4
3
7
5
9
1
2
8
10
10
P
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each having the electrophotographic photosensitive member.

2. Description of the Related Art

Electrophotographic photosensitive members are each basically formed of: a photosensitive layer on which an electrostatic latent image is to be formed by charging and exposure; and a conductive support on which the photosensitive layer is to be provided. At present, semiconductor laser has been mainly used as a light source in an electrophotographic apparatus using any one of the electrophotographic photosensitive members, and investigations have been conducted on the potential of materials sensitive to the oscillatory wavelength of the semiconductor laser, i.e., around 790 nm, which is a relatively long wavelength, to find applications in charge-generating substances for use in the charge generation layers of the electrophotographic photosensitive members. Of the materials, such organic pigments as described below each of which is sensitive to light having a long wavelength have been frequently used: various metal phthalocyanines such as aluminum chlorophthalocyanine, chloroindium phthalocyanine, oxyvanadyl phthalocyanine, chlorogallium phthalocyanine, magnesium phthalocyanine, and oxytitanium phthalocyanine; and metal-free phthalocyanines.

The following procedure has been performed with a view to improving the characteristics of each of the electrophotographic photosensitive members such as developing performance: an intermediate layer is provided between the conductive support and the photosensitive layer. Each of the following resins has been known to serve as a material of which the intermediate layer is formed: polyamide (Japanese Patent Application Laid-open No. Sho 58-95351), polyester (Japanese Patent Application Laid-open No. Sho 52-20836), a vinyl acetate-ethylene copolymer (Japanese Patent Application Laid-open No. Sho 48-26141), chlorinated ethylene (Japanese Patent Application Laid-open No. 2005-10591), a maleic anhydride ester polymer (Japanese Patent Application Laid-open No. Sho 52-10138), polyvinyl butyral (Japanese Patent Application Laid-open No. Sho 57-90639), and a quaternary ammonium salt-containing polymer (Japanese Patent Application Laid-open No. Sho 51-126149). In addition, the intermediate layer has been formed by: dissolving any such resin in a solvent to prepare an application liquid for an intermediate layer; applying the liquid to the support; and heating the applied liquid.

However, each of those resins has high hygroscopicity in many cases because the resin has a functional group having large polarity in its molecular chain. In addition, the resistance of each of the resins varies to a large extent depending on the humidity of the ambience surrounding the resin. Therefore, when the intermediate layer is formed of any one of those resins alone, an increase in residual potential of each of the electrophotographic photosensitive members and fluctuations in electrical characteristics of each of the electrophotographic photosensitive members under a low-temperature, low-humidity environment, or high-temperature, high-humidity environment occur, and the extent to which image defects are alleviated is insufficient.

SUMMARY OF THE INVENTION

The present invention provides an electrophotographic photosensitive member having the following characteristics, and a process cartridge and an electrophotographic apparatus each having the electrophotographic photosensitive member: a fluctuation in sensitivity by an environment is suppressed, and a fluctuation in potential by duration is moderate (a fluctuation in potential when the electrophotographic photosensitive member is repeatedly used is suppressed).

The inventors of the present invention have made extensive studies on the above problems. As a result, the inventors have completed the present invention described below.

The present invention relates to an electrophotographic photosensitive member, including: a conductive support; an intermediate layer provided on the conductive support; and a photosensitive layer provided on the intermediate layer, in which the intermediate layer contains a polyolefin resin having the following repeating structural units (A1), (A2), and (A3), and a mass ratio (%) of the unit (A2) in the polyolefin resin is 0.01 mass % or more and 30 mass % or less:

(A1): a repeating structural unit represented by the following formula (11)

(11)

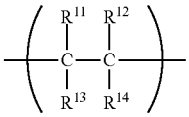

where $R^{11}$ to $R^{14}$ each independently represent a hydrogen atom or an alkyl group;

(A2): a repeating structural unit represented by one of the following formulae (21) and (22)

(21)

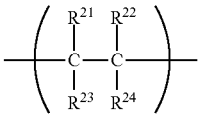

(22)

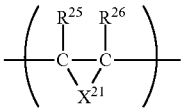

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}$COOCO$Y^{23}$— where $Y^{22}$ and $Y^{23}$ each independently represent a single bond, an alkylene group, or an arylene group, provided that at least one of $R^{21}$ to $R^{24}$ represents a monovalent group represented by —$Y^{21}$COOH; and (A3): a repeating structural unit represented by any one of the following formulae (31), (32), (33), and (34)

(31)

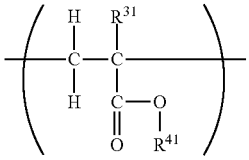

(32)

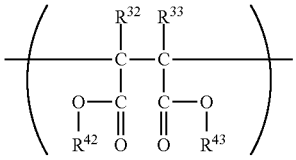

(33)

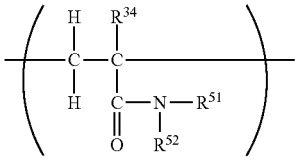

(34)

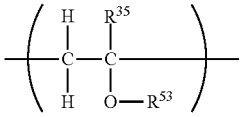

where $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent, a hydrogen atom or an alkyl group having 1 to 10 carbon atoms.

According to another aspect of the present invention, there are provided a process cartridge and an electrophotographic apparatus each having the above electrophotographic photosensitive member.

According to the present invention, there can be provided an electrophotographic photosensitive member having the following characteristics, and a process cartridge and an electrophotographic apparatus each having the electrophotographic photosensitive member: a fluctuation in sensitivity by an environment is suppressed, and a fluctuation in potential by duration is moderate.

Further features of the present invention will become apparent from the following description of exemplary embodiments with reference to the attached drawings.

BRIEF DESCRIPTION OF THE DRAWINGS

FIG. 1 is a view illustrating an example of the outline constitution of an electrophotographic apparatus including a process cartridge having an electrophotographic photosensitive member of the present invention.

DESCRIPTION OF THE EMBODIMENTS

Hereinafter, an electrophotographic photosensitive member of the present invention is described in detail.

The electrophotographic photosensitive member of the present invention includes: a conductive support; an intermediate layer provided on the conductive support; and a photosensitive layer provided on the intermediate layer, in which the intermediate layer contains a polyolefin resin having the following repeating structural units (A1), (A2), and (A3), and a mass ratio (%) of the unit (A2) in the polyolefin resin is 0.01 mass % or more and 30 mass % or less:

(A1): a repeating structural unit represented by the following formula (11)

(11)

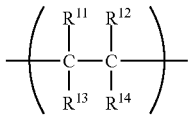

where $R^{11}$ to $R^{14}$ each independently represent a hydrogen atom or an alkyl group;

(A2): a repeating structural unit represented by one of the following formulae (21) and (22)

(21)

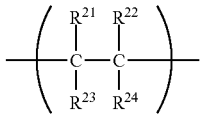

(22)

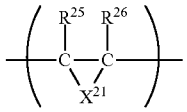

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}$COOCO$Y^{23}$— where $Y^{22}$ and $Y^{23}$ each independently represent a single bond, an alkylene group, or an arylene group, provided that at least one of $R^{21}$ to $R^{24}$ represents a monovalent group represented by —$Y^{21}$COOH; and (A3): a repeating structural unit represented by any one of the following formulae (31), (32), (33), and (34)

(31)

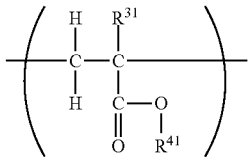

(32)

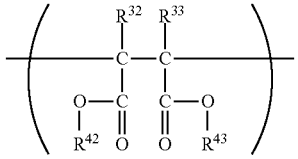

-continued (33)

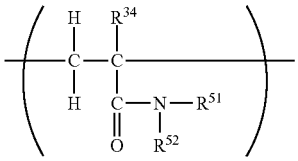

(34)

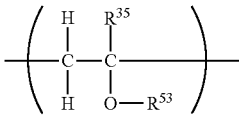

where $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms.

In other words, the intermediate layer of the electrophotographic photosensitive member of the present invention has the following characteristics: the intermediate layer contains the above polyolefin resin having the repeating structural units (A1), (A2), and (A3), and the mass ratio (%) of the unit (A2) in the above polyolefin resin is 0.01 mass % or more and 30 mass % or less. When the mass ratio (%) of the unit (A2) is less than 0.01 mass %, a fluctuation in potential of the electrophotographic photosensitive member by duration is apt to be large; when the mass ratio (%) exceeds 30 mass %, the sensitivity of the electrophotographic photosensitive member deteriorates, and the extent to which the sensitivity fluctuates owing to an environment becomes large.

In addition, the intermediate layer used in the present invention may contain metal oxide particles, an organic electron-transporting material, or carbon black as required, and the mass ratio (%) of the above polyolefin resin in the intermediate layer is preferably 25% to 100%.

In addition, the mass ratios (%) of the units (A1) and (A3) in the above polyolefin resin preferably satisfy the following relationship from the viewpoint of an additional improvement of an effect of the present invention:

$$55/45 \leqq (A1)/(A3) \leqq 99/1. \qquad \text{Formula (II)}$$

The mass ratio (%) of the unit (A1) alone in the polyolefin resin is preferably 60 mass % or more, or more preferably 70 mass % or more. When the mass ratio (%) of the unit (A1) falls within such ranges, an influence on the sensitivity of the electrophotographic photosensitive member by the fluctuation of an environment becomes small.

The mass ratio (%) of the unit (A2) in the above polyolefin resin is preferably 0.01 mass % or more and 10 mass % or less because the effect of the present invention is improved; the mass ratio is more preferably 0.01 mass % or more and 5 mass % or less, or still more preferably 3 mass % or more and 5 mass % or less.

In addition, the mass ratios (%) of the units (A1), (A2), and (A3) in the above polyolefin resin preferably satisfy the following formula (I), or more preferably satisfy the following formula (III):

$$0.02 \leqq (A2)/\{(A1)+(A2)+(A3)\} \times 100 \leqq 10 \qquad \text{Formula (I)}$$

$$0.01 \leqq (A2)/\{(A1)+(A2)+(A3)\} \times 100 \leqq 5. \qquad \text{Formula (III)}$$

The polyolefin resin used in the present invention is a copolymer, and is a resin synthesized by copolymerizing monomers each having a carbon-carbon double bond as raw materials.

A monomer for constituting the unit (A2) in the present invention is a compound having at least one of or both of a carboxylic acid group and a carboxylic anhydride group in any one of its molecules (monomer unit). The compound having at least one of a carboxylic acid group and a carboxylic anhydride group is preferably at least one of or both of an unsaturated carboxylic acid and an anhydride of the acid. Specific examples thereof include acrylic acid, methacrylic acid, maleic acid, maleic anhydride, itaconic acid, itaconic anhydride, fumaric acid, and crotonic acid, half esters of unsaturated dicarboxylic acids, and half amides. Of those, acrylic acid, methacrylic acid, maleic acid, and maleic anhydride are preferable, and acrylic acid and maleic anhydride are most preferable.

Further, the form of the copolymer is not particularly limited and may include random copolymers, block copolymers, and graft copolymers.

In the above formula (21), it is preferred that $R^{21}$ to $R^{24}$ each independently represent a hydrogen atom, an alkyl group having 1 to 7 carbon atoms, a phenyl group, or a monovalent group represented by —$Y^{21}$COOH (where $Y^{21}$ represents a single bond, an alkylene group having 1 to 4 carbon atoms, or an arylene group), and at least one of $R^{21}$ to $R^{24}$ represent a monovalent group represented by —$Y^{21}$COOH; it is more preferred that three of $R^{21}$ to $R^{24}$ each represent a hydrogen atom and the remaining one represent —COOH, or two of $R^{21}$ to $R^{24}$ each represent a hydrogen atom, one of them represent a methyl group, and the remaining one represent —COOH.

In addition, in the formula (22), it is preferred that $R^{25}$ and $R^{26}$ each independently represent a hydrogen atom, an alkyl group having 1 to 7 carbon atoms, or a phenyl group, and $X^{21}$ represent a divalent group represented by —$Y^{22}$COOCO$Y^{23}$— (where $Y^{22}$ and $Y^{23}$ each independently represent a single bond, an alkylene group having 1 to 4 carbon atoms, or an arylene group); it is more preferred that $R^{25}$, and $R^{26}$ each represent a hydrogen atom and $X^{21}$ represent —COOCO—.

It should be noted that the unsaturated carboxylic anhydride such as maleic anhydride is as follows: when the resin is in a dry state, carboxyl groups adjacent to each other undergo cyclodehydration to form an acid anhydride structure. However, in, for example, an aqueous medium containing a basic compound, part or all of the molecules of the unsaturated carboxylic anhydride undergo ring-opening so that the molecules may tend to adopt the structure of a carboxylic acid or a salt of the acid. In addition, when the amount of the compound having a carboxylic acid group or carboxylic anhydride group is calculated with reference to the amount of the carboxyl groups of the resin in the present invention, the calculation is performed on the assumption that all carboxylic anhydride groups in the resin undergo ring-opening to form carboxyl groups.

Examples of monomers constituting the unit (A3) in the present invention include the following compounds.

Formula (31): (meth)acrylates such as methyl (meth)acrylate, ethyl(meth)acrylate, and butyl (meth)acrylate.

Formula (32): Maleates such as dimethyl maleate, diethyl maleate, and dibuthyl maleate.

Formula (33): (meth)acrylic acid amides.

Formula (34): alkyl vinyl ethers such as methyl vinyl ether and ethyl vinyl ether, and vinyl alcohols obtained by saponifying vinyl esters with basic compounds.

It should be noted that one kind of those compounds may be used alone, or two or more kinds of them may be used as a mixture.

Of those, the (meth)acrylates are preferable, and methyl acrylate or ethyl acrylate is more preferable. That is, it is more preferred that, in the above formula (31), $R^{31}$ represent a hydrogen atom and $R^{41}$ represent a methyl or ethyl group. In addition, as described above, the mass ratio (%) of the unit (A3) in the polyolefin resin preferably satisfies the following relationship:

$$55/45 \leqq (A1)/(A3) \leqq 99/1. \quad \text{Formula (II)}$$

The mass ratio (%) of the unit (A3) alone is preferably 1 mass % or more and 20 mass % or less, or more preferably 10 mass % or more and less than 20 mass %. When the mass ratio (%) of the unit (A3) in the polyolefin resin satisfies the above range, an influence on the potential of the electrophotographic photosensitive member by duration easily becomes small.

Examples of monomers for constituting the unit (A1) in the present invention include alkenes such as ethylene, propylene, isobutylene, 1-butene, 1-pentene, and 1-hexene. Those may be used alone or in combination. Of those, alkenes having 2 to 4 carbon atoms, such as ethylene, propylene, isobutylene, and 1-butene are more preferable, and ethylene is most preferable. That is, $R^{11}$ to $R^{14}$ in the above formula (II) each independently represent preferably a hydrocarbon atom or an alkyl group having 1 to 6 carbon atoms, and all of $R^{11}$ to $R^{14}$ are more preferably a hydrogen atom.

The polyolefin resin used in the present invention is particularly preferably a ternary copolymer formed of ethylene, methyl(meth)acrylate or ethyl (meth)acrylate, and maleic anhydride. Specific examples of the ternary copolymer include an ethylene-maleic anhydride-acrylate ternary copolymer and an ethylene-maleic anhydride-methacrylate ternary copolymer.

The polyolefin resin used in the present invention may contain a component (repeating structural unit) derived from any monomer other than those described above as a component of the copolymer to such an extent that the effect of the present invention is not impaired. Specific examples of the other monomers include dienes, (meth)acrylonitrile, vinyl halides, vinylidene halides, carbon monoxide, and carbon disulfide. It should be noted that the total mass ratio (%) of the units (A1), (A2), and (A3) in the above polyolefin resin is preferably 90% to 100%.

Although the molecular weight of the polyolefin resin used in the present invention is not particularly limited, a resin having a molecular weight of 10,000 to 100,000 is preferably used, and a resin having a molecular weight of 20,000 to 50,000 is more preferably used. A method of synthesizing the polyolefin resin is not particularly limited either. The above polyolefin resin can be obtained by, for example, subjecting monomers for constituting the polyolefin resin to high-pressure radical copolymerization in the presence of a radical generator. In addition, any one of the known methods described in the chapters 1 to 4 of "New Polymer Experiment 2 Synthesis and Reaction of Polymer (1)" (Kyoritsu Shuppan Co., Ltd.), Japanese Patent Application Laid-open No. 2003-105145, and Japanese Patent Application Laid-open No. 2003-147028 can be employed as a specific method of synthesizing the polyolefin resin.

In the present invention, the characteristics of the resin were measured or evaluated by the following methods.

(1) Content of Unsaturated Carboxylic Acid Component in Polyolefin Resin Represented by (A2)

The acid value of the polyolefin resin was measured in conformity with JIS K5407, and the content (graft ratio) of the unsaturated carboxylic acid was determined from the value with the following equation.

Content (mass %) of unsaturated carboxylic acid component=(mass of grafted unsaturated carboxylic acid)/(mass of raw material polyolefin resin)×100

(2) Constitution of Resin Except (A2)

The content of a component except the component (A2) was determined by performing $^{1}$H-NMR and $^{13}$C-NMR analysis with an analyzer (manufactured by Varian Technologies Japan Limited, 300 MHz) in o-dichlorobenzene (d4) at 120° C. The $^{13}$C-NMR analysis was performed by employing a gated decoupling method taking quantitativeness into consideration.

A method of preparing an application liquid for the intermediate layer is, for example, a method of preparing the liquid involving dissolving the polyolefin resin in a solvent, a method of preparing the liquid involving retaining the polyolefin resin at a high temperature equal to or higher than the softening point of the resin to turn the resin into a molten state, or a method of preparing the liquid involving stirring the polyolefin resin in a solvent under heat to turn it into a dispersion.

In addition, the intermediate layer can be formed through the application of the application liquid for the intermediate layer by an application method such as a dip application method (dip coating method), a roll coating method, a spray coating method, a curtain coating method, or a spin coating method; the dip coating method is preferable in terms of the efficiency and the productivity.

Examples of the conductive support used in the present invention include: metals such as aluminum, nickel, copper, gold, and iron, and alloys of the metals; conductive supports each obtained by forming a thin film formed of a metal such as aluminum, silver, or gold or of a conductive material such as indium oxide or tin oxide on an insulating support formed of, for example, polyester, polycarbonate, polyimide, or glass; and conductive supports each obtained by dispersing carbon or a conductive filler in a resin to impart conductivity to the resin. In addition, the shape of the conductive support is not particularly limited, and a conductive support of a plate shape, drum shape, or belt shape is used as required. The surface of such conductive support may be subjected to an electrochemical treatment such as anodization or a chemical treatment involving the use of a solution prepared by dissolving a compound of a metal salt or a metal salt of a fluorine compound in an acidic aqueous solution mainly formed of an alkaline phosphate, phosphoric acid, or tannic acid in order that the electrical characteristics, or adhesiveness may be improved.

In addition, when the electrophotographic photosensitive member is used in an electrophotographic apparatus using laser light beams having a single wavelength, the surface of the conductive support is preferably roughened to a moderate extent so that interference fringes may be suppressed.

The surface of the conductive support is preferably treated by honing, blasting, cutting, or electrolytic polishing. Alternatively, a conductive layer formed of a conductive metal oxide and a binder resin is preferably formed on a conductive support formed of aluminum or an aluminum alloy.

Methods for the above honing treatment are classified into a dry method and a wet method; each of them may be employed in the present invention. A wet honing treatment is a method involving: suspending a powdery abrasive in a liquid such as water; and spraying the suspension on the surface of the support at a high speed to roughen the surface. The surface roughness of the support can be controlled depending on the pressure and speed at which the suspension is sprayed, the amount, kind, shape; size, hardness, and specific gravity of the abrasive, and the temperature at which the abrasive is suspended. Meanwhile, a dry honing treatment is a method involving spraying an abrasive on the surface of the support at a high speed with air to roughen the surface, and the surface roughness can be controlled by the same method as in the case of the wet honing treatment. Examples of the abrasive used in the wet or dry honing treatment include particles each formed of silicon carbide, alumina, or iron, and glass beads.

When the above conductive layer formed of the conductive metal oxide and the binder resin is formed by application on the conductive support formed of aluminum or an aluminum alloy, conductive particles are preferably incorporated into the conductive layer. The incorporation of the conductive particles into the conductive layer in the method has the following effect: the laser light beams are irregularly reflected so that interference fringes may be suppressed, and flaws in, and protruded portions on, the surface of the conductive support may be hidden. For example, zinc oxide, titanium oxide, or barium sulfate is used in each of the conductive particles. In addition, each of the conductive particles can be provided with a conductive coat layer formed of tin oxide as required so that the particles may serve as a filler having a proper resistivity.

The resistivity of the above conductive particles is preferably 0.1 to 1,000 Ω·cm, or more preferably 1 to 1,000 Ω·cm. In the present invention, the resistivity of the conductive particles was measured with a resistance-measuring apparatus Loresta AP manufactured by Mitsubishi Chemical Corporation. The conductive particles as measuring objects were compacted at a pressure of 500 kg/cm$^2$ to be turned into a coin-shaped sample, and the sample was mounted on the above measuring apparatus.

In addition, the average particle diameter of the above conductive particles is preferably 0.05 to 1.0 μm, or more preferably 0.07 to 0.7 μm. In the present invention, the average particle diameter of the conductive particles is a value measured by a centrifugal sedimentation method.

Further, the content of the above conductive particles as a filler is preferably 1.0 to 90 mass %, or more preferably 5.0 to 80 mass % with respect to the total mass of the conductive layer. The conductive coat layer may contain fluorine or antimony as required.

Examples of the binder resin used in the above conductive layer include a phenol resin, polyurethane, polyamide, polyimide, polyamide-imide, polyamic acid, polyvinyl acetal, an epoxy resin, an acrylic resin, a melamine resin, and polyester. One kind of those resins may be used alone, or two or more kinds of them may be used in combination. Any such resin is preferably used because the resin improves: the adhesiveness of the above conductive layer to the conductive support; the dispersing performance of the conductive particles; and the solvent resistance of the layer after its formation. Of the above resins, the phenol resin, polyurethane, or polyamic acid is particularly preferable.

The above conductive layer can be formed through, for example, dip coating or application with a Meyer bar. The thickness of the conductive layer is preferably 0.1 to 30 μm, or more preferably 0.5 to 20 μm. In addition, the volume resistivity of the conductive layer is preferably $1.0\times10^5$ Ω·cm or more and $1.0\times10^{13}$ Ω·cm or less, or more preferably $1.0\times10^5$ Ω·cm or more and $1.0\times10^{12}$ Ω·cm or less.

In the present invention, the volume resistivity was determined by: forming the conductive layer as a measuring object on an aluminum plate; further forming a thin film formed of gold on the conductive layer; and measuring a current flowing between both electrodes, i.e., the aluminum plate and the thin film formed of gold with a pA meter. Further, a leveling agent may be added to the conductive layer for improving the surface characteristic of the layer.

The electrophotographic photosensitive member of the present invention has the conductive support, the intermediate layer provided on the conductive support, and the photosensitive layer provided on the intermediate layer. Known examples of the photosensitive layer include a single-layer type photosensitive layer and a laminate type photosensitive layer. The laminate type photosensitive layer preferably includes at least a charge generation layer and a charge transport layer.

The charge generation layer is preferably formed by incorporating a charge-generating substance, a binder resin, and any other component. The charge generation layer can be formed by, for example, a method involving: dissolving the binder resin in a solvent; adding and dispersing the charge-generating substance to and in the solution; applying the resultant application liquid for a charge generation layer; and drying the applied liquid. A media type dispersing machine such as a sand mill or ball mill, or a liquid-collision type dispersing machine can be used upon dispersion of the charge-generating substance.

Examples of the charge-generating substance include pyrylium-based dyes, thiopyrylium-based dyes, phthalocyanine-based pigments, anthanthrone-based pigments, dibenzpyrenequinone-based pigments, pyranthrone-based pigments, azo-based pigments, indigo-based pigments, quinacridone-based pigments, and quinocyanine-based pigments. Examples of the phthalocyanine-based pigments include non-metallic phthalocyanines, oxytitanium phthalocyanine, hydroxygallium phthalocyanine, and halogenated gallium phthalocyanines such as chlorogallium phthalocyanine. Those charge-generating substances may be used alone or in combination.

In the charge generation layer, when mixing a phthalocyanine-based pigment and a charge-generating substance other than phthalocyanine-based pigments, it is also preferable to include 50 mass % or less of the charge-generating substance other than phthalocyanine-based pigments with respect to the total of the charge-generating substance. In this case, examples of the charge-generating substance other than phthalocyanine-based pigments include selenium-tellurium-, pyrylium-, and thiapyrylium-based dyes, and each type of pigments such as anthanthrone-, dibenzpyrenequinone-, trisazo-, cyanine-, disazo-, monoazo-, indigo-, quinacridone-, and asymmetric quinocyanine-based pigments.

The charge generation layer may be formed by applying an application liquid for a charge generation layer prepared by dispersing a charge generating substance together with a binder resin and a solvent at amass ratio of 0.3 to 4 times volume, using a dispersing unit such as a homogenizer, an ultrasonic dispersing unit, a ball mill, a vibration ball mill, a sand mill, an attritor, a roll mill, or a liquid collision-type high-speed dispersing unit, and drying the applied liquid. Examples of the binder resin include, but are not limited to, a butyral resin, a polyester resin, a polycarbonate resin, a polyarylate resin, a polystyrene resin, a polyvinyl methacrylate resin, a polyvinyl acrylate resin, a polyvinyl acetate resin, a polyvinyl chloride resin, a polyamide resin, a polyurethane resin, a silicone resin, an alkyd resin, an epoxy resin, a cellulose resin, and a melamine resin. Of those, a butyral resin is particularly preferable.

The charge transport layer preferably includes a charge-transporting substance in a molecular dispersion state and a binder resin. The charge transport layer may be formed by applying an application liquid for a charge transport layer prepared by dissolving a binder resin having film forming property and a charge transporting substance and then drying the applied liquid. Examples of the charge transport substance include, but are not limited to, polycylic aromatic compounds, heterocylic compounds, hydrazone-based compounds, styryl-based compounds, benzidine-based compounds, triarlyamine-based compounds, and triphenylamine, and a polymer having a group formed of those compounds in the main chain or a side chain.

Examples of the binder resin used in the charge transport layer include, but are not limited to, polyester, polycarbonate, polymethacrylate, polyarylate, polysulfone, and polystyrene. Of those, polycarbonate and polyarylate are particularly preferable.

A process cartridge of the present invention includes: the electrophotographic photosensitive member of the present invention; and at least one devices selected from the group consisting of charging devices, developing devices, transferring devices, and cleaning devices, in which the process cartridge integrally supports the electrophotographic photosensitive member and the at least one devices, and is attachable to and detachable from a main body of an electrophotographic apparatus.

An electrophotographic apparatus of the present invention includes: the electrophotographic photosensitive member of the present invention; charging devices; exposing devices; developing devices; and transferring devices.

FIG. 1 illustrates an example of the outline constitution of an electrophotographic apparatus including a process cartridge having the electrophotographic photosensitive member of the present invention.

In FIG. 1, a drum-shaped electrophotographic photosensitive member 1 is rotated around a shaft 2 in the direction indicated by an arrow at a predetermined circumferential speed. The circumferential surface (surface) of the electrophotographic photosensitive member 1 thus rotated is uniformly charged to a predetermined negative potential by charging devices 3 (primary charging devices), and then receives exposure light (image exposure light) 4 output from exposing devices (not illustrated) such as slit exposure or laser beam scanning exposure. Thus, electrostatic latent images corresponding to a target image are sequentially formed on the circumferential surface of the electrophotographic photosensitive member 1. A voltage applied to the charging devices 3 may be a voltage obtained by superimposing an AC component on a DC component, or may be a voltage formed only of a DC component; only a DC component was applied to the charging devices used in the present invention.

The electrostatic latent images formed on the circumferential surface of the electrophotographic photosensitive member 1 are each developed with toner from developing devices 5 to serve as a toner image. Next, the toner images formed on and carried by the circumferential surface of the electrophotographic photosensitive member 1 are sequentially transferred by a transferring bias from transferring devices 6 (transfer roller). A transfer material P (such as paper) is taken out of transfer material-feeding devices (not illustrated) to be fed to a portion between the electrophotographic photosensitive member 1 and the transferring devices 6 (abutting portion) in synchronization with the rotation of the electrophotographic photosensitive member 1. The transfer material P onto which the toner images have been transferred is separated from the circumferential surface of the electrophotographic photosensitive member 1, and is then introduced into fixing devices 8 to undergo image fixation. As a result, the transfer material as an image-formed product (a print or copy) is printed out of the apparatus.

A transfer residual developer (toner) is removed from the surface of the electrophotographic photosensitive member 1 after the transfer of the toner images by cleaning devices 7 (cleaning blade) so that the surface may be cleaned. Further, the surface is subjected to an antistatic treatment by pre-exposure light 11 from pre-exposing devices (not illustrated) before the electrophotographic photosensitive member is repeatedly used for image formation. It should be noted that, for example, transferring devices based on an intermediate transfer system using a belt- or drum-shaped intermediate transfer body may be adopted as the transferring devices. In FIG. 1, the electrophotographic photosensitive member 1, the charging devices 3, the developing devices 5, and the cleaning devices 7 are integrally supported to serve as a process cartridge 9 attachable to and detachable from the main body of the electrophotographic apparatus with the aid of guide 10 such as a rail of the main body of the electrophotographic apparatus.

Hereinafter, the present invention is described specifically by way of examples. However, the present invention is not limited to those examples. It should be noted that the term "part(s)" in the following description refers to "part(s) by mass."

An electrophotographic photosensitive member was produced with a polyolefin resin containing a combination of species (A1), (A2), and (A3) shown in Table 1 below at mass ratios (%) shown in Table 1 below by the following method. It should be noted that the species (A1), (A2), and (A3) in: Table 1 are represented by the names of monomers before polymerization.

TABLE 1

| Polyolefin | (A1) Mass ratio | Species (A1) | (A2) Mass ratio | Species (A2) | (A3) Mass ratio | Species (A3) |
|---|---|---|---|---|---|---|
| B-1 | 79.00 | Ethylene | 3.00 | Maleic anhydride | 18.00 | Ethyl acrylate |
| B-2 | 60.00 | Ethylene | 1.00 | Maleic anhydride | 39.00 | Ethyl acrylate |
| B-3 | 80.00 | Ethylene | 5.00 | Maleic anhydride | 15.00 | Methyl acrylate |
| B-4 | 87.00 | Ethylene | 3.00 | Maleic anhydride | 10.00 | Ethyl acrylate |
| B-5 | 79.00 | Ethylene | 3.00 | Acrylic acid | 18.00 | Dimethyl maleate |
| B-6 | 79.00 | Ethylene | 3.00 | Acrylic acid | 18.00 | Acrylamide |
| B-7 | 79.00 | Ethylene | 3.00 | Acrylic acid | 18.00 | Ethyl vinyl ether |
| B-8 | 92.00 | Ethylene | 7.00 | Maleic anhydride | 1.00 | Ethyl acrylate |
| B-9 | 70.00 | Ethylene | 10.00 | Maleic anhydride | 20.00 | Ethyl acrylate |
| B-10 | 70.00 | Ethylene | 20.00 | Maleic anhydride | 10.00 | Ethyl acrylate |
| B-11 | 68.00 | Ethylene | 30.00 | Maleic anhydride | 2.00 | Ethyl acrylate |
| B-12 | 65.00 | Ethylene | 35.00 | Maleic anhydride | 0.00 | Ethyl acrylate |
| B-13 | 79.00 | Ethylene | 3.00 | Maleic anhydride | 18.00 | Butyl methacrylate |
| B-14 | 80.00 | Ethylene | 0.01 | Maleic anhydride | 19.99 | Ethyl acrylate |
| B-15 | 55.00 | Ethylene | 0.00 | — | 45.00 | Butyl acrylate |
| B-16 | 75.00 | Ethylene | 25.00 | Acrylic acid | 0.00 | — |
| B-17 | 30.00 | Ethylene | 55.00 | Acrylic acid | 15.00 | Butyl acrylate |

EXAMPLE 1

First, 75.0 g of the resin (B-1), 60.0 g of 2-propanol (hereinafter referred to as "IPA"), 5.1 g of triethylamine (hereinafter referred to as "TEA"), and 159.9 g of distilled water were loaded into a sealable, pressure-resistant glass container provided with a stirring machine and a heater and having a volume of one liter, and the mixture was stirred while the rotational speed of a stirring blade was set to 300 rpm. As a result, no granular resin precipitate was observed at the bottom of the container, but the resin was observed to be in a floating state. Here, 10 minutes after the observation, the heater was turned on to heat the mixture while the state was maintained. Then, the mixture was stirred for an additional 20 minutes while the temperature in the system was kept at 140 to 145° C. After that, the system was immersed in a water bath, and the temperature in the system was lowered to room temperature (about 25° C.) while the mixture was stirred with the rotational speed kept at 300 rpm. After that, the mixture was filtrated with a 300-mesh stainless filter (wire diameter 0.035 mm, plain weave) under pressure (at an air pressure of 0.2 MPa). As a result, an opaque, uniform aqueous dispersion liquid (C-1) containing polyolefin resin particles was obtained.

Meanwhile, 0.2 mol of tin(IV) chloride pentahydrate was dissolved in 200 ml of water so that a 0.5-M aqueous solution might be obtained. Then, 28% ammonia water was added to the aqueous solution while the aqueous solution was stirred. As a result, white tin oxide ultrafine particle-containing slurry having a pH of 1.5 was obtained. After the resultant tin oxide ultrafine particle-containing slurry had been heated to 70° C., the slurry was naturally cooled to around 50° C., and then pure water was added to the slurry so that one liter of tin oxide ultrafine particle-containing slurry might be obtained. Then, the slurry was subjected to solid-liquid separation with a centrifugal separator. Next, 800 ml of pure water were added to the water-containing solid, and the mixture was subjected to stirring and dispersion with a homogenizer. After that, washing was performed through the solid-liquid separation of the mixture with a centrifugal separator. Then, 75 ml of pure water were added to a water-containing solid after the washing so that tin oxide ultrafine particle-containing slurry might be prepared. Next, 3.0 ml of triethylamine were added to the resultant tin oxide ultrafine particle-containing slurry, and the mixture was stirred. When the mixture started to be transparent, the mixture was heated to 70° C. After that, the heating was stopped, and the mixture was naturally cooled. As a result, a tin oxide sol solution using an organic amine having a solid concentration of 20 mass % as a dispersion stabilizer was obtained. Then, 99 parts of the aqueous dispersion liquid (C-1), 875 parts of the above tin oxide sol solution, and 350 parts of IPA were mixed. As a result, an application liquid for an intermediate layer was prepared.

An aluminum blank tube (ED tube: JIS-A3003) having an outer diameter of 30.5 mm, an inner diameter of 28.5 mm, and a length of 260.5 mm obtained by hot extrusion was prepared as a conductive support. A solution formed of 120 parts of a powder formed of barium sulfate fine particles each having a coat layer formed of tin oxide (coverage 50 mass %, powder resistivity 700 Ω·cm), 70 parts of a resol type phenol resin (trade name: Plyophen J-325, manufactured by DIC Corporation, solid content 700), and 100 parts of 2-methoxy-1-propanol was prepared, and the powder was subjected to a dispersion treatment with a ball mill for about 20 hours. As a result, an application liquid for a conductive layer was prepared (the average particle diameter of the powder in the application liquid was 0.22 μm). The application liquid for a conductive layer was applied onto the conductive support by dip coating, and was then cured by being heated for 30 minutes at 140° C. As a result, a conductive layer having a thickness of 15 μm was formed.

The above application liquid for an intermediate layer was applied onto the conductive layer by dip coating, and was then dried for 10 minutes at 120° C. As a result, an intermediate layer having a thickness of 0.8 μm was formed.

Next, 10 parts of a polyvinyl butyral resin (trade name: BX-1, manufactured by SEKISUI CHEMICAL CO., LTD.) and 350 parts of cyclohexanone were added to 20 parts of a hydroxygallium phthalocyanine crystal as a charge-generating substance, and the mixture was subjected to a dispersion treatment with a sand mill using glass beads each having a diameter of 1 mm for 3 hours. Then, 1,200 parts of ethyl acetate were added to dilute the mixture. As a result, an application liquid for a charge generation layer was prepared. In this case, the dispersed particle diameter of the charge-generating substance in the application liquid measured with a natural/centrifugal sedimentation type particle size distribution-measuring apparatus (CAPA-700, manufactured by HORIBA, Ltd.) was 0.15 μm. The application liquid for a charge generation layer was applied onto the intermediate layer by dip coating, and was then dried for 10 minutes at 100° C. As a result, a charge generation layer having a thickness of 0.2 μm was formed.

Next, 7 parts of a compound represented by the following structural formula (7), 1 part of a compound represented by the following structural formula (8), and 10 parts of a bisphenol C type polyallylate resin having a constitutional unit represented by the following structural formula (9) (having a weight-average molecular weight [Mw] of 110,000) were dissolved in a mixed solvent formed of 50 parts of monochlorobenzene and 10 parts of dichloromethane. As a result, an application liquid for a charge transport layer was prepared. The application liquid for a charge transport layer was applied onto the above charge generation layer by dip coating, and was then dried for 1 hour at 110° C. As a result, a charge transport layer having a thickness of 18 μm was formed. Thus, the electrophotographic photosensitive member was produced.

(7)

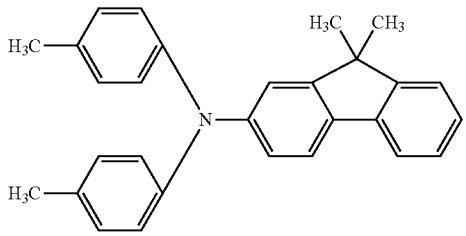

(8)

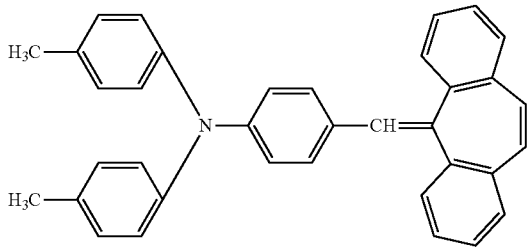

-continued (9)

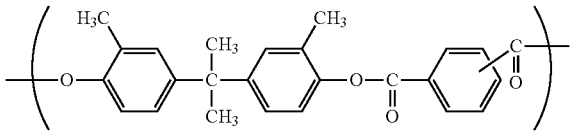

Methods of evaluating the electrophotographic photosensitive member are as described below.

The light potential of the electrophotographic photosensitive member produced in the foregoing under a normal-temperature, normal-humidity environment having a temperature of 23° C. and a humidity of 50% RH was measured with a reconstructed apparatus of a color laser printer "LaserJet 4600" manufactured by Hewlett-Packard Company (charging: roller contact DC charging, dark potential −500 V, process speed 100 mm/sec, laser exposure, light quantity 0.3 μJ/cm$^2$), and the light potential was defined as the sensitivity of the electrophotographic photosensitive member. In addition, the light potential of the electrophotographic photosensitive member under a low-temperature, low-humidity environment having a temperature of 15° C. and a humidity of 10% RH was measured, and then images each having an image density of 4% were output on 3,000 sheets. Then, the light potential of the electrophotographic photosensitive member under the low-temperature, low-humidity environment was measured again. A difference between the light potential under the above normal-temperature, normal-humidity environment and the light potential under the above low-temperature, low-humidity environment was defined as a fluctuation by an environment, and a difference between the light potential before the above image output and the light potential after the image output was defined as a fluctuation in potential by duration. Table 2 shows the results. It should be noted that the sensitivity is preferably less than 130 V, and the fluctuation by an environment and the fluctuation in potential by duration are preferably 20 V or less and 19 V or less, respectively. When the fluctuation by an environment and the fluctuation in potential by duration are large, a variation in density among the resultant images becomes large, so the fluctuation by an environment and the fluctuation in potential by duration are more preferably 15 V or less and 18 V or less, respectively; further, when the stability of an image density is needed, the fluctuation by an environment and the fluctuation in potential by duration must be 10 V or less and 15 V or less, respectively.

EXAMPLE 2

First, 1,000 parts of glass beads each having a diameter of 1 mm were added to 100 parts of titanium oxide (TTO55N, manufactured by Ishihara Sangyo Kaisha, Ltd.), 750 parts of methanol, and 50 parts of distilled water, and the mixture was subjected to a dispersion treatment with a paint shaker for 15 hours. As a result, a titanium oxide dispersion liquid was obtained. Then, an electrophotographic photosensitive member was produced in the same manner as in Example 1 except that the tin oxide sol solution of the application liquid for an intermediate layer in Example 1 was changed to 900 parts of the titanium oxide dispersion liquid. In addition, the resultant electrophotographic photosensitive member was evaluated in the same manner as in Example 1. Table 2 shows the results.

EXAMPLE 3

An electrophotographic photosensitive member was produced in the same manner as in Example 2 except that titanium oxide in Example 2 was changed to another product (titanium oxide, PT401M, manufactured by Ishihara Sangyo Kaisha, Ltd.). In addition, the resultant electrophotographic photosensitive member was evaluated in the same manner as in Example 1. Table 2 shows the results.

EXAMPLE 4

An electrophotographic photosensitive member was produced in the same manner as in Example 2 except that titanium oxide in Example 2 was changed to another product (titanium oxide, PT301M, manufactured by Ishihara Sangyo Kaisha, Ltd.). In addition, the resultant electrophotographic photosensitive member was evaluated in the same manner as in Example 1. Table 2 shows the results.

EXAMPLE 5

First, 25 parts of a compound represented by the following structural formula (10) were dissolved in a mixed solvent of 350 parts of cyclohexanone and 350 parts of methanol. Then, an electrophotographic photosensitive member was produced in the same manner as in Example 1 except that the tin oxide sol solution of the application liquid for an intermediate layer in Example 1 was changed to 725 parts of the solution of the compound represented by the structural formula (10). In addition, the resultant electrophotographic photosensitive member was evaluated in the same manner as in Example 1. Table 2 shows the results.

Structural formula (10)

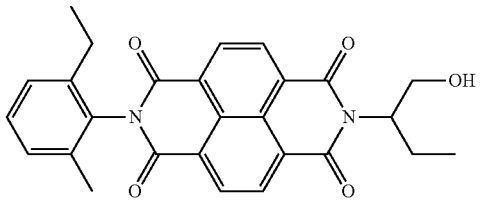

It should be noted that the compound represented by the structural formula (10) can be synthesized by employing any one of the known synthesis methods described in U.S. Pat. Nos. 4,442,193, 4,992,349, and 5,468,583. To be specific, the compound was synthesized by the following method. In a stream of nitrogen, 20 parts of 1,4,5,8-naphthalene tetracarboxylic dianhydride and 1 part of imidazole were mixed, and 50 parts of 2-methyl-6-ethylaniline and 7.3 parts of 2-amino-1-butanol were added to the mixture. Then, the resultant was stirred under heat at 170° C. for 3 hours. After the completion of the reaction, 500 ml of toluene were added to the resultant, and the mixture was subjected to separation and purification by silica gel column chromatography. The resultant brown liquid was heated, and was then cooled. As a result, 10 parts of a yellowish white crystal were obtained. The molecular weight of the crystal was measured by mass spectrometry with an MALDI-TOF MS (ultraflex manufactured by Bruker Daltonics, accelerating voltage: 20 kV, mode: Reflector, molecular weight standard product: fullerene $C_{60}$). As a result, a peak top value of 456 was obtained. In addition, the crystal was identified as the compound represented by the structural formula (10) by infrared absorption spectrum and proton NMR.

The infrared absorption spectrum was performed with a Fourier transform infrared spectrophotometer manufactured by PerkinElmer Japan Co., Ltd. (trade name: Paragon 1000) by a KBr tablet method at a resolution of 4 $cm^{-1}$, and the NMR was performed with an R-1100 manufactured by Hitachi, Ltd. by using: a solution prepared by dissolving the crystal in $CDCl_3$ as a solvent and having a concentration of 10%; and TMS as an internal standard.

EXAMPLE 6

An electrophotographic photosensitive member was produced in the same manner as in Example 5 except that the compound represented by the structural formula (10) in Example 5 was changed to a compound represented by the following structural formula (11). In addition, the resultant electrophotographic photosensitive member was evaluated in the same manner as in Example 1. Table 2 shows the results.

Structural formula (11)

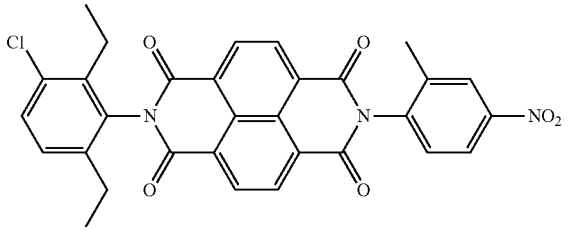

The compound represented by the structural formula (II) was synthesized in the same manner as in the case of the compound represented by the structural formula (10) except that 2-methyl-6-ethylaniline and 2-amino-1-butanol used in the synthesis of the compound represented by the structural formula (10) were changed to 2,6-diethyl-3-chloroaniline and 2-methyl-4-nitroaniline.

EXAMPLE 7

An electrophotographic photosensitive member was produced in the same manner as in Example 5 except that the compound represented by the structural formula (10) in Example 5 was changed to a compound represented by the following structural formula (12). In addition, the resultant electrophotographic photosensitive member was evaluated in the same manner as in Example 1. Table 2 shows the results.

Structural formula (12)

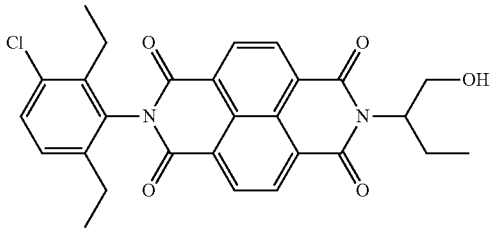

The compound represented by the structural formula (12) was synthesized in the same manner as in the case of the compound represented by the structural formula (10) except that 2-methyl-6-ethylaniline used in the synthesis of the compound represented by the structural formula (10) was changed to 2,6-diethyl-3-chloroaniline.

EXAMPLE 8

First, an aqueous dispersion liquid (C-13) containing polyolefin resin particles was prepared in the same manner as in Example 1 except that the resin (B-1) in Example 1 was changed to the resin (B-13) shown in Table 1. Then, an electrophotographic photosensitive member was produced in the same manner as in Example 1 except that an application liquid for an intermediate layer was prepared by mixing 99 parts of the aqueous dispersion liquid (C-13), 700 parts of distilled water, and 200 parts of IPA. In addition, the resultant electrophotographic photosensitive member was evaluated in the same manner as in Example 1. Table 2 shows the results.

EXAMPLE 9

An electrophotographic photosensitive member was produced in the same manner as in Example 1 except that an application liquid for an intermediate layer was prepared by mixing 80 parts of the aqueous dispersion liquid (C-1), 875 parts of the tin oxide sol solution, 5 parts of N-methoxymethylated nylon 6, and 350 parts of IPA in Example 1. In addition, the resultant electrophotographic photosensitive member was evaluated in the same manner as in Example 1. Table 2 shows the results.

EXAMPLE 10

First, an aqueous dispersion liquid (C-14) containing polyolefin resin particles was prepared in the same manner as in Example 1 except that the resin (B-1) in Example 1 was changed to the resin (B-14) shown in Table 1. Then, an electrophotographic photosensitive member was produced in the same manner as in Example 1 except that: an application liquid for an intermediate layer was prepared by mixing 99 parts of the aqueous dispersion liquid (C-14), 700 parts of distilled water, and 200 parts of IPA; and the thickness of the intermediate layer was changed to 0.3 μm. In addition, the resultant electrophotographic photosensitive member was evaluated in the same manner as in Example 1. Table 3 shows the results.

EXAMPLE 11

First, an aqueous dispersion liquid (C-2) was prepared by changing the resin (B-1) in Example 1 to the resin (B-2). Then, an electrophotographic photosensitive member was produced in the same manner as in Example 1 except that: an application liquid for an intermediate layer was prepared by mixing 99 parts of the aqueous dispersion liquid (C-2), 835 parts of distilled water, and 65 parts of IPA; and the thickness of the intermediate layer was changed to 0.3 μm. In addition, the resultant electrophotographic photosensitive member was evaluated in the same manner as in Example 1. Table 3 shows the results.

EXAMPLE 12

An electrophotographic photosensitive member was produced in the same manner as in Example 1 except that: an application liquid for an intermediate layer was prepared by mixing 99 parts of the aqueous dispersion liquid (C-1), 645 parts of distilled water, and 280 parts of IPA in Example 1; and the thickness of the intermediate layer was changed to 0.3 μm. In addition, the resultant electrophotographic photosensitive member was evaluated in the same manner as in Example 1. Table 3 shows the results.

EXAMPLE 13

An electrophotographic photosensitive member was produced in the same manner as in Example 10 except that an aqueous dispersion liquid (C-3) containing resin particles prepared by changing the resin (B-14) used in Example 10 to the resin (B-3) shown in Table 1 was used. In addition, the resultant electrophotographic photosensitive member was evaluated in the same manner as in Example 1. Table 3 shows the results.

EXAMPLE 14

An electrophotographic photosensitive member was produced in the same manner as in Example 1 except that an application liquid for an intermediate layer was prepared by mixing 60 parts of the aqueous dispersion liquid (C-1), 700 parts of distilled water, 200 parts of IPA, and 10 parts of N-methoxymethylated nylon 6; and the thickness of the intermediate layer was changed to 0.3 μm. In addition, the resultant electrophotographic photosensitive member was evaluated in the same manner as in Example 1. Table 3 shows the results.

EXAMPLE 15

An electrophotographic photosensitive member was produced in the same manner as in Example 10 except that an aqueous dispersion liquid (C-4) containing resin particles prepared by changing the resin (B-14) used in Example 10 to the resin (B-4) shown in Table 1 was used. In addition, the resultant electrophotographic photosensitive member was evaluated in the same manner as in Example 1. Table 3 shows the results.

EXAMPLE 16

An electrophotographic photosensitive member was produced in the same manner as in Example 10 except that an aqueous dispersion liquid (C-5) containing resin particles prepared by changing the resin (B-14) used in Example 10 to the resin (B-5) shown in Table 1 was used. In addition, the resultant electrophotographic photosensitive member was evaluated in the same manner as in Example 1. Table 3 shows the results.

EXAMPLE 17

An electrophotographic photosensitive member was produced in the same manner as in Example 10 except that an aqueous dispersion liquid (C-6) containing resin particles prepared by changing the resin (B-14) used in Example 10 to the resin (B-6) shown in Table 1 was used. In addition, the resultant electrophotographic photosensitive member was evaluated in the same manner as in Example 1. Table 3 shows the results.

EXAMPLE 18

An electrophotographic photosensitive member was produced in the same manner as in Example 10 except that an aqueous dispersion liquid (C-7) containing resin particles prepared by changing the resin (B-14) used in Example 10 to the resin (B-7) shown in Table 1 was used. In addition, the resultant electrophotographic photosensitive member was evaluated in the same manner as in Example 1. Table 3 shows the results.

EXAMPLE 19

An electrophotographic photosensitive member was produced in the same manner as in Example 10 except that an aqueous dispersion liquid (C-8) containing resin particles prepared by changing the resin (B-14) used in Example 10 to the resin (B-8) shown in Table 1 was used. In addition, the resultant electrophotographic photosensitive member was evaluated in the same manner as in Example 1. Table 3 shows the results.

EXAMPLE 20

An electrophotographic photosensitive member was produced in the same manner as in Example 10 except that an aqueous dispersion liquid (C-9) containing resin particles prepared by changing the resin (B-14) used in Example 10 to the resin (B-9) shown in Table 1 was used. In addition, the resultant electrophotographic photosensitive member was evaluated in the same manner as in Example 1. Table 3 shows the results.

EXAMPLE 21

An electrophotographic photosensitive member was produced in the same manner as in Example 10 except that an aqueous dispersion liquid (C-10) containing resin particles prepared by changing the resin (B-14) used in Example 10 to the resin (B-10) shown in Table 1 was used. In addition, the resultant electrophotographic photosensitive member was evaluated in the same manner as in Example 1. Table 3 shows the results.

EXAMPLE 22

An electrophotographic photosensitive member was produced in the same manner as in Example 10 except that an aqueous dispersion liquid (C-11) containing resin particles prepared by changing the resin (B-14) used in Example 10 to the resin (B-11) shown in Table 1 was used. In addition, the resultant electrophotographic photosensitive member was evaluated in the same manner as in Example 1. Table 3 shows the results.

COMPARATIVE EXAMPLE 1

An electrophotographic photosensitive member was produced in the same manner as in Example 10 except that an aqueous dispersion liquid (C-12) containing resin particles prepared by changing the resin (B-14) used in Example 10 to the resin (B-12) shown in Table 1 was used. In addition, the resultant electrophotographic photosensitive member was evaluated in the same manner as in Example 1. Table 3 shows the results.

COMPARATIVE EXAMPLE 2

An electrophotographic photosensitive member was produced in the same manner as in Example 10 except that an aqueous dispersion liquid (C-15) containing resin particles prepared by changing the resin (B-14) used in Example 10 to the resin (B-15) shown in Table 1 was used. In addition, the resultant electrophotographic photosensitive member was evaluated in the same manner as in Example 1. Table 3 shows the results.

COMPARATIVE EXAMPLE 3

An electrophotographic photosensitive member was produced in the same manner as in Example 10 except that an aqueous dispersion liquid (C-16) containing resin particles prepared by changing the resin (B-14) used in Example 10 to the resin (B-16) shown in Table 1 was used. In addition, the resultant electrophotographic photosensitive member was evaluated in the same manner as in Example 1. Table 3 shows the results.

COMPARATIVE EXAMPLE 4

An electrophotographic photosensitive member was produced in the same manner as in Example 10 except that an aqueous dispersion liquid (C-17) containing resin particles prepared by changing the resin (B-14) used in Example 10 to the resin (B-17) shown in Table 1 was used. In addition, the resultant electrophotographic photosensitive member was evaluated in the same manner as in Example 1. Table 3 shows the results.

COMPARATIVE EXAMPLE 5

An electrophotographic photosensitive member was produced in the same manner as in Example 10 except that an aqueous solution of an ethylene-acrylic acid copolymer resin SG2000 (manufactured by Namariichi Co., Ltd.) was used as an application liquid for an intermediate layer. In addition, the resultant electrophotographic photosensitive member was evaluated in the same manner as in Example 1. Table 3 shows the results.

COMPARATIVE EXAMPLE 6

An electrophotographic photosensitive member was produced in the same manner as in Example 10 except that a solution prepared by dissolving 10 parts of an ethylene-vinyl acetate copolymer resin ELVAX4260 (manufactured by Du Pont Kabushiki Kaisha) in 200 parts of toluene was used as an application liquid for an intermediate layer. In addition, the resultant electrophotographic photosensitive member was evaluated in the same manner as in Example 1. Table 3 shows the results.

COMPARATIVE EXAMPLE 7

An electrophotographic photosensitive member was produced in the same manner as in Example 10 except that parts of a chlorinated ethylene resin SUPERCHLON (manufactured by Nippon Paper Industries Co., Ltd.) and 200 parts of toluene were used as an application liquid for an intermediate layer. In addition, the resultant electrophotographic photosensitive member was evaluated in the same manner as in Example 1. Table 3 shows the results.

TABLE 2

| | (A2)/((A1) + (A2) + (A3)) × 100 | Formula (II) | A1 | A2 | A3 | Fluctuation by environment | Fluctuation by duration | Sensitivity |
|---|---|---|---|---|---|---|---|---|
| Example 1 | 3 | 4.39 | 79 | 3 | 18 | 3 | 5 | 100 |
| Example 2 | ↑ | ↑ | ↑ | ↑ | ↑ | 5 | 8 | 100 |
| Example 3 | ↑ | ↑ | ↑ | ↑ | ↑ | 5 | 8 | 105 |
| Example 4 | ↑ | ↑ | ↑ | ↑ | ↑ | 5 | 8 | 105 |
| Example 5 | ↑ | ↑ | ↑ | ↑ | ↑ | 5 | 8 | 105 |
| Example 6 | ↑ | ↑ | ↑ | ↑ | ↑ | 5 | 9 | 105 |
| Example 7 | ↑ | ↑ | ↑ | ↑ | ↑ | 5 | 9 | 105 |
| Example 8 | ↑ | ↑ | ↑ | ↑ | ↑ | 5 | 9 | 100 |
| Example 9 | ↑ | ↑ | ↑ | ↑ | ↑ | 5 | 7 | 100 |
| Example 10 | 0.01 | 4 | 80 | 0.01 | 19.99 | 10 | 20 | 115 |
| Example 11 | 1 | 1.54 | 60 | 1 | 39 | 12 | 20 | 115 |
| Example 12 | 3 | 4.39 | 79 | 3 | 18 | 6 | 15 | 112 |
| Example 13 | 5 | 5.33 | 80 | 5 | 15 | 5 | 15 | 110 |
| Example 14 | 3 | 4.39 | 79 | 3 | 18 | 7 | 15 | 110 |
| Example 15 | 3 | 8.7 | 87 | 3 | 10 | 5 | 14 | 113 |
| Example 16 | 3 | 4.39 | 79 | 3 | 18 | 11 | 16 | 118 |
| Example 17 | 3 | 4.39 | 79 | 3 | 18 | 12 | 15 | 118 |
| Example 18 | 3 | 4.39 | 79 | 3 | 18 | 10 | 15 | 117 |
| Example 19 | 7 | 92 | 92 | 7 | 1 | 15 | 19 | 128 |
| Example 20 | 10 | 3.5 | 70 | 10 | 20 | 18 | 18 | 128 |
| Example 21 | 20 | 7 | 70 | 20 | 10 | 20 | 18 | 127 |
| Example 22 | 30 | 34 | 68 | 30 | 2 | 23 | 18 | 128 |

TABLE 3

| | (A2)/((A1) + (A2) + (A3)) × 100 | Formula (II) | A1 | A2 | A3 | Fluctuation by environment | Fluctuation by duration | Sensitivity |
|---|---|---|---|---|---|---|---|---|
| Comparative Example 1 | 35 | — | 65 | 35 | 0 | 30 | 35 | 135 |
| Comparative Example 2 | 0 | 1.22 | 55 | 0 | 45 | 25 | 50 | 120 |
| Comparative Example 3 | 25 | — | 75 | 25 | 0 | 22 | 35 | 128 |

TABLE 3-continued

| | (A2)/((A1) + (A2) + (A3)) × 100 | Formula (II) | A1 | A2 | A3 | Fluctuation by environment | Fluctuation by duration | Sensitivity |
|---|---|---|---|---|---|---|---|---|
| Comparative Example 4 | 55 | 2 | 30 | 55 | 15 | 34 | 30 | 145 |
| Comparative Example 5 | — | — | — | — | — | 25 | 38 | 140 |
| Comparative Example 6 | — | — | — | — | — | 24 | 45 | 140 |
| Comparative Example 7 | — | — | — | — | — | 26 | 40 | 142 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-252077, filed Nov. 2, 2009 which is hereby incorporated by reference herein in its entirety.

What is claimed is:

1. An electrophotographic photosensitive member, comprising:

a conductive support;

an intermediate layer provided on the conductive support; and a photosensitive layer provided on the intermediate layer, wherein the intermediate layer contains a polyolefin resin having the following repeating structural units (A1), (A2), and (A3), and mass ratios (%) of the units (A1), (A2), and (A3) in the polyolefin resin satisfy the following formulae (II) and (III):

$$55/45 \leqq (A1)/(A3) \leqq 99/1; \text{ and} \qquad \text{Formula (II)}$$

$$0.01 \leqq (A2)/\{(A1)+(A2)+(A3)\} \times 100 \leqq 5; \qquad \text{Formula (III)}$$

(A1): a repeating structural unit represented by the following formula (11)

(11)

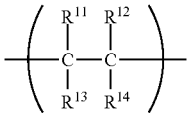

where $R^{11}$ to $R^{14}$ each independently represent a hydrogen atom or an alkyl group;

(A2): a repeating structural unit represented by one of the following formulae (21) and (22)

(21)

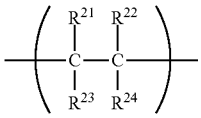

-continued (22)

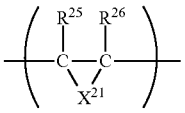

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group, $R^{25}$ and $R^{26}$ each independently represent a hydrogen atom, an alkyl group, or a phenyl group, and $X^{21}$ represents a divalent group represented by —$Y^{22}$COOCO$Y^{23}$— where $Y^{22}$ and $Y^{23}$ each independently represent a single bond, an alkylene group, or an arylene group, provided that at least one of $R^{21}$ to $R^{24}$ represents a monovalent group represented by —$Y^{21}$COOH; and (A3): a repeating structural unit represented by any one of the following formulae (31), (32), (33), and (34)

(31)

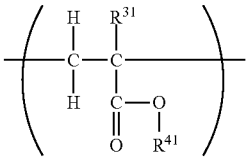

(32)

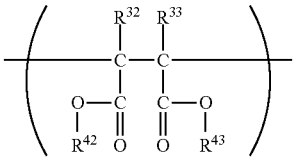

(33)

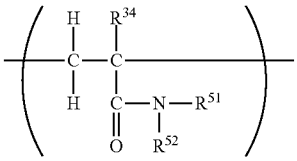

(34)

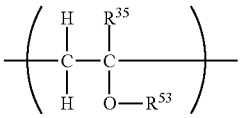

where $R^{31}$ to $R^{35}$ each independently represent a hydrogen atom or a methyl group, $R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms.

2. An electrophotographic photosensitive member according to claim 1, wherein the polyolefin resin comprises one of an ethylene-maleic anhydride-acrylate ternary copolymer and an ethylene-maleic anhydride-methacrylate ternary copolymer.

3. A process cartridge, comprising:

the electrophotographic photosensitive member according to claim 1; and at least one devices selected from the group consisting of charging devices, developing devices, transferring devices, and cleaning devices, wherein the process cartridge integrally supports the electrophotographic photosensitive member and the at least one devices, and is detachable from a main body of an electrophotographic apparatus.

4. An electrophotographic apparatus, comprising:

the electrophotographic photosensitive member according to claim 1;

charging devices;

exposing devices;

developing devices; and transferring devices.

* * * * *